US006149280A

United States Patent [19]

Quiogue et al.

[11] Patent Number: 6,149,280

[45] Date of Patent: Nov. 21, 2000

[54] METHOD AND APPARATUS FOR RETROFITTING CANOPY LUMINAIRE ASSEMBLIES

[75] Inventors: Honesto D. Quiogue, Florence, Ky.; Ronald E. Leonard, Cincinnati, Ohio

[73] Assignee: Spaulding Lighting, Inc., Cincinnati, Ohio

[21] Appl. No.: 09/245,375

[22] Filed: Feb. 5, 1999

[51] Int. Cl.[7] ..... F21S 8/02

[52] U.S. Cl. ..... 362/147; 362/368; 362/427; 362/287

[58] Field of Search ..... 362/147, 364, 362/365, 368, 226, 287, 427

[56] References Cited

U.S. PATENT DOCUMENTS

| | | |
|---|---|---|
| D. 24,496 | 7/1895 | Keeler et al. . |
| D. 24,498 | 7/1895 | Keeler et al. . |
| D. 38,972 | 12/1907 | Goehst . |
| D. 147,093 | 7/1947 | Vorsanger . |
| D. 170,084 | 7/1953 | Glatthar et al. . |

(List continued on next page.)

FOREIGN PATENT DOCUMENTS

| | | |
|---|---|---|
| 539841 | 4/1957 | Canada . |
| 4139521 | 6/1993 | Germany . |
| 3167705 | 7/1991 | Japan . |

OTHER PUBLICATIONS

"The New Generation Scottsdale" brochure, LSI, 1998.
"The Scottsdale Superkit," brochure, LSI, 1998.
"The Scottsdale RIC Superkit," brochure, LSI, 1998.
Sales Brochure, Hubbell Lighting, Inc., "Parimaliter® II Glass—PGM Series", p. 439.
Sales Brochure, Cooper Lighting, "Lumark®" QF Qradra–Lume, p. 337.

(List continued on next page.)

*Primary Examiner*—Thomas M. Sember
*Attorney, Agent, or Firm*—Hunton & Williams

[57] ABSTRACT

A method and apparatus for retrofitting canopy luminaire assemblies from an existing canopy luminaire mounted on the canopy. The existing light fixture is removed. Housing brackets are attached to housing flanges of the existing canopy housing. An adapter plate comprises a plate with a deck plate bracket having a latch. The adapter plate is mounted to the housing brackets by use of the latch. The adapter plate may comprise a deck plate and an assembly plate which are pivotably attached to enable an installer to connect the lighting source to the electrical components in the housing. A lighting assembly, comprising a light source, lens, and reflector, is attached to the adapter plate.

19 Claims, 9 Drawing Sheets

U.S. PATENT DOCUMENTS

| | | | |
|---|---|---|---|
| D. 186,185 | 9/1959 | Benjamin | D48/16 |
| D. 232,376 | 8/1974 | Yahraus et al. . | |
| D. 249,291 | 9/1978 | Pemberton . | |
| D. 262,914 | 2/1982 | Kristofek | D26/135 |
| D. 286,579 | 11/1986 | Pugh et al. . | |
| D. 301,628 | 6/1989 | Fuller . | |
| D. 304,092 | 10/1989 | Glassman | D26/85 |
| D. 312,842 | 12/1990 | Younger et al. | D20/42 |
| D. 315,216 | 3/1991 | Kelley et al. . | |
| D. 321,406 | 11/1991 | Schlesselman . | |
| D. 324,113 | 2/1992 | Morrison . | |
| D. 343,015 | 1/1994 | Yuen . | |
| D. 352,797 | 11/1994 | Mehaffey . | |
| D. 356,169 | 3/1995 | Lyons . | |
| D. 375,180 | 10/1996 | Lyons | D26/28 |
| D. 375,379 | 11/1996 | DiCola et al. . | |
| D. 377,841 | 2/1997 | Vakil | D26/85 |
| D. 377,991 | 2/1997 | Vakil | D26/85 |
| 1,248,187 | 11/1917 | Smith . | |
| 1,573,580 | 2/1926 | Ruttle . | |
| 1,595,972 | 8/1926 | Reamer . | |
| 1,683,599 | 9/1928 | Berry . | |
| 2,007,528 | 7/1935 | Graham . | |
| 2,225,057 | 12/1940 | Kuntz . | |
| 2,225,217 | 12/1940 | Hicok . | |
| 2,463,046 | 3/1949 | Naysmith . | |
| 2,534,992 | 12/1950 | Reid . | |
| 2,700,751 | 1/1955 | Hallerberg . | |
| 2,712,120 | 6/1955 | Cochran . | |
| 2,744,716 | 5/1956 | Zingone . | |
| 2,899,542 | 8/1959 | De Mauro . | |
| 2,954,201 | 9/1960 | Pascucci et al. . | |
| 2,965,348 | 12/1960 | Gerstel et al. . | |
| 2,971,670 | 2/1961 | McCormack . | |
| 2,975,271 | 3/1961 | Dvorak . | |
| 2,998,510 | 8/1961 | Versen . | |
| 3,012,133 | 12/1961 | Archer . | |
| 3,037,110 | 5/1962 | Williams . | |
| 3,069,541 | 12/1962 | Thomsen et al. . | |
| 3,130,949 | 4/1964 | Erhardt et al. . | |
| 3,158,329 | 11/1964 | Wince . | |
| 3,176,255 | 3/1965 | Jensen . | |
| 3,353,015 | 11/1967 | Franklin et al. . | |
| 3,370,165 | 2/1968 | Chan . | |
| 3,375,368 | 3/1968 | Dorsky . | |
| 3,387,255 | 6/1968 | Earleywine, Jr. . | |
| 3,488,626 | 1/1970 | Koerper et al. . | |
| 3,511,982 | 5/1970 | Salter . | |
| 3,518,420 | 6/1970 | Kripp . | |
| 3,654,453 | 4/1972 | Jablonski . | |
| 3,660,651 | 5/1972 | Miles, Jr. . | |
| 3,671,739 | 6/1972 | McCain . | |
| 3,675,007 | 7/1972 | Appleton et al. . | |
| 3,697,742 | 10/1972 | Bobrick . | |
| 3,720,432 | 3/1973 | Chudler . | |
| 3,745,327 | 7/1973 | Lowery et al. | 240/9 R |
| 3,755,667 | 8/1973 | Price . | |
| 3,778,609 | 12/1973 | Liberman . | |
| 3,872,296 | 3/1975 | Cohen et al. . | |
| 3,883,732 | 5/1975 | Peterson et al. . | |
| 3,900,725 | 8/1975 | Komon . | |
| 4,025,782 | 5/1977 | Kaeser . | |
| 4,071,749 | 1/1978 | Balogh . | |
| 4,091,444 | 5/1978 | Mori . | |
| 4,128,865 | 12/1978 | Johnson . | |
| 4,141,061 | 2/1979 | Ford et al. . | |
| 4,161,019 | 7/1979 | Mulvey . | |
| 4,232,361 | 11/1980 | Kelsall . | |
| 4,250,540 | 2/1981 | Kristofek . | |
| 4,255,781 | 3/1981 | Plemmons et al. . | |
| 4,274,615 | 6/1981 | Chan et al. . | |
| 4,293,895 | 10/1981 | Kristofek . | |
| 4,298,919 | 11/1981 | Karasawa . | |
| 4,302,798 | 11/1981 | Sit . | |
| 4,313,153 | 1/1982 | Davis . | |
| 4,315,302 | 2/1982 | Petralia . | |
| 4,327,403 | 4/1982 | Capostagno et al. . | |
| 4,336,575 | 6/1982 | Gilman . | |
| 4,384,316 | 5/1983 | de Vos et al. . | |
| 4,388,674 | 6/1983 | Sano . | |
| 4,388,681 | 6/1983 | Meyer . | |
| 4,403,278 | 9/1983 | Flood . | |
| 4,408,262 | 10/1983 | Kusmer . | |
| 4,419,717 | 12/1983 | Price et al. . | |
| 4,459,648 | 7/1984 | Ullman . | |
| 4,460,948 | 7/1984 | Malola . | |
| 4,471,411 | 9/1984 | Graham et al. . | |
| 4,490,778 | 12/1984 | Collins et al. . | |
| 4,512,098 | 4/1985 | Ready et al. . | |
| 4,516,196 | 5/1985 | Blake . | |
| 4,518,896 | 5/1985 | Miles, Jr. . | |
| 4,547,840 | 10/1985 | Tinder . | |
| 4,633,377 | 12/1986 | Mackiewicz | 362/309 |
| 4,636,924 | 1/1987 | Targetti . | |
| 4,654,768 | 3/1987 | Dryman et al. . | |
| 4,703,406 | 10/1987 | Elliott et al. . | |
| 4,716,504 | 12/1987 | Pahl et al. . | |
| 4,739,460 | 4/1988 | Kelsall . | |
| 4,748,543 | 5/1988 | Swarens . | |
| 4,754,383 | 6/1988 | Klaus . | |
| 4,760,510 | 7/1988 | Lahti . | |
| 4,763,231 | 8/1988 | Houplain . | |
| 4,809,468 | 3/1989 | Bareiss . | |
| 4,827,386 | 5/1989 | Mackiewicz . | |
| 4,837,669 | 6/1989 | Tharp et al. . | |
| 4,870,549 | 9/1989 | Lauckhardt et al. . | |
| 4,881,157 | 11/1989 | Pahl . | |
| 4,885,665 | 12/1989 | Birillo . | |
| 4,910,650 | 3/1990 | Goralnik . | |
| 4,999,757 | 3/1991 | Poppenheimer . | |
| 5,034,869 | 7/1991 | Choi . | |
| 5,045,984 | 9/1991 | Trowbridge et al. . | |
| 5,057,979 | 10/1991 | Carson et al. . | |
| 5,068,772 | 11/1991 | Shapiro et al. . | |
| 5,083,248 | 1/1992 | Troy . | |
| 5,122,944 | 6/1992 | Webb . | |
| 5,136,490 | 8/1992 | Morrison . | |
| 5,161,878 | 11/1992 | Degelmann et al. . | |
| 5,163,749 | 11/1992 | Wu . | |
| 5,174,642 | 12/1992 | Brohard et al. . | |
| 5,174,648 | 12/1992 | Clary et al. . | |
| 5,222,800 | 6/1993 | Chan et al. . | |
| 5,228,773 | 7/1993 | Win . | |
| 5,272,605 | 12/1993 | Johnstone . | |
| 5,289,358 | 2/1994 | Halemeier . | |
| 5,309,342 | 5/1994 | Heinen, Sr. . | |
| 5,331,531 | 7/1994 | Unger et al. . | |
| 5,349,513 | 9/1994 | Taylor, III . | |
| 5,373,431 | 12/1994 | Hayman et al. . | |
| 5,374,812 | 12/1994 | Chan et al. . | |
| 5,376,020 | 12/1994 | Jones . | |
| 5,377,088 | 12/1994 | Lecluze . | |
| 5,379,199 | 1/1995 | Hirshenhorn et al. . | |
| 5,381,320 | 1/1995 | Jordan . | |
| 5,428,515 | 6/1995 | Jung . | |
| 5,461,550 | 10/1995 | Johnstone . | |
| 5,463,540 | 10/1995 | Jones . | |
| 5,491,618 | 2/1996 | Vakil . | |
| 5,548,499 | 8/1996 | Zadeh . | |
| 5,560,707 | 10/1996 | Neer . | |
| 5,562,341 | 10/1996 | Strauss . | |
| 5,562,343 | 10/1996 | Chan et al. . | |

| | | | |
|---|---|---|---|
| 5,567,041 | 10/1996 | Slocum . | |
| 5,574,600 | 11/1996 | Agro . | |
| 5,599,094 | 2/1997 | Fischer et al. . | |
| 5,609,414 | 3/1997 | Caluori . | |
| 5,636,463 | 6/1997 | Sharon et al. . | |
| 5,662,407 | 9/1997 | Fischer et al. . | |
| 5,803,585 | 9/1998 | Littman et al. . | |
| 5,828,765 | 10/1998 | Gable . | |
| 6,059,422 | 5/2000 | Fischer et al. | 362/147 |

OTHER PUBLICATIONS

Sales Brochure, Cooper Lighting, "Lumark®" RY Roadway Cobrahead; p. 343.
Sales Brochure, Caprii® Lighting, Recessed Fluorescent, p. C–31.
Sales Brochure, Industrial Lighting, GE Lighting Systems UniGlow® 400/1000 Luminaire; Jan. 1997, p. 38.
Sales Brochure, Roadway Lighting, GE Lighting Systems, VersaFlood II Signliter, Jan. 1997, p. 290.
Sales Brochure, Roadway Lighting; GE Lighting Systems; "Turnpike Luminaire™", Jan. 1997; p. 292.
Sales Brochure, Industrial Lighting; GE Lighting Systems, Minimount™ Luminaire; Jan. 1997; p. 84.
Sales Brochure, Lithonia Lighting; "2 '×2" General Area Lighting, Lensed Refractor; p. 311.
Sales Brochure, Incandescent LA Series; "Square Lens", p. 131.
Sales Brochure, Lithonia Lighting; "Wall–Mounted Area Lighter, Glass Refractor"; p. 266.
Sales Brochure; Visa Lighting.
Sales Brochures, L20™ and L21™ Series; LLCYL™ Cylinder Series; CAND™ Candela Series.
Sales Brochure BEGA, pp. 3,5,7,13,15,17,23,25,27,37,43.
Sales Brochure Prescolite; pp. 181, 243.
Sales Brochures, KIM Lighting "Path or Border Lights" pp. C2–12; "Pathlighters" pp. C2–14.
Sales Brochure, Holophane p. 28,53,55,68,86,99,118,133, 135,137,148,152,173.
Sales Brochure KIM Lighting, "Features"; p. 4.
Sales Brochure, Refractor Information; Sterner, p. 10.
Sales Brochure KIM Lighting, "Specifications: Fixtures"; p. 13.
Sales Brochure, Blackrock® Series 415.
Sales Brochure; Hubbell Lighting, Inc. "Enclosed and Gasketed —Kemlux® II KH Series" p. 323.
Sales Brochure, GCV Series '12 Square HID Ceiling Mount; p. 1–2.
Sales Brochure Cooper Lighting LUMARK® Parking Garage; pp. 1–2.
Sales Brochure Kennall Manufacturing: "KENALL® Lighting for Tough Environments" Paragon pp. 1–2.
Sales Brochure Architectural Area Lighting "ALR 156 Nautical".
Sales Brochure RV Series METROLUX® Roadway Lighting Solutions "Ceiling Mounted Luminaries"; pp. 2–4.
Sales Brochure; Hubbell Lighting, Inc. Perimamite™; p. 435.
Sales Brochure, Hubbell Lighting, Inc.; "Perimapak™Series"; p. 436.
Sales Brochure, Quality Lighting; "Design CB".
Sales Brochure, Quality Lighting; "Design DL" p. 6.
Sales Brochure "JUNO".
Sales Brochure, WLM Medium Wall Light; "Day–Brite" p. H65.
Sales Brochure; HBY Industra I Open/Enclosed 400; "Day–Brie HBY Industra I Open/Enclosed 400" p. H17.
Sales Brochure; METROLUX™ "SV Series Ceiling Mounted Luminaires"; pp. 2–4.
Sales Brochure; METROLUX™ "RV Series Ceiling Mounted Luminaires"; pp. 2–4.
Sales Brochure KIM Lighting; "Wall Forms™ Cast ALuminum" pp. 20–21.
Sales Brochure, HID Lighting Fixtures; "Metal Halide" p. 1.
Sales Brochure, KIM Lighting "Permanence" p. 4.
Sales Brochure KIM Lighting, "Uncompromised Quality" p. 8.
Sales Brochure KIM Lighting; p. 10.
Sales Brochure Guth Lighting: Outdoor; p. 1.
Sales Brochure Incandescent Vapolet Day–Brite® Incandescent; p. F–98.
Sales Brochure Cooper Lighting Lumark®; WL WAL–PAK; p. 35.
Sales Brochure Devine Lighting; Steplights LMS400/LMS500/LMS600; p. D1–2.
Sales Brochure Devine Lighting; Wallpacks/Security B275/B280/B380/B300; p. E3–4.
Sales Brochure Devine Lighting "Downlights/Round & Square D420/D450 Series"; p. F1–1.
Sales Brochure Devine Lighting "Downlights/Round & Square E540/E551 Series"; p. F1–2.
Sales Brochure METROLUX® Roadway Lighting Solutions "RV Series Ceiling Mounted Luminaires"; pp. 1–2.
Sales BrochureDevine Lighting; Accent Surface/Wall Mount TRG Series; p. E1–5; CCG Series; pp. E1–4.
*Dropped Borosilicate Prismatic Glass Lens*, Whiteway of Cincinnati, OH, P. B5a, Sep. 1997.
Kenal—*Number One in Vandalproof Lighting*, p. 284–285, 290–291, 300–301.

METHOD AND APPARATUS FOR RETROFITTING CANOPY LUMINAIRE ASSEMBLIES

FIELD OF THE INVENTION

The present invention relates to the field of securing canopy luminaries, and more particularly to securing canopy luminaries in place of existing fixtures.

BACKGROUND OF THE INVENTION

Canopy luminaire assemblies ("assemblies") are used in many areas, such as for gas stations, restaurant drive-through windows, and other areas where over-head lighting is desirable. Canopy luminaire assemblies generally comprise relatively high power light sources to distribute a large amount of light to outdoor areas. As such, these fixtures generally comprise electrical components, including a ballast and a light source connected to the ballast. The ballast and light source are generally housed in a single housing that is then affixed to the canopy. Many of these canopy luminaires dispose the housing above the canopy and then cut a large hole in the canopy through which the light may project. These luminaires may be referred to as recessed box type luminaires. A lens structure may then be disposed on the underside of the canopy.

Over time, it may be desirable to replace existing luminaires for a number of reasons. For example, it is generally desirable to have all luminaires for a given canopy or series of canopies to have the same appearance for aesthetic purposes. If an addition is made, or remodeling occurs, a different looking fixture may be selected. Therefore, it may be desirable to replace or modify existing fixtures to look like the remodeled design. Removing the fixture may leave a large hole that may need to be patched to fit a remodeled design having a different shape. This requires additional labor and, therefore, may create a disincentive to replace existing luminaires with a different design.

Further, patching requires additional labor costs because it involves the use of saws, drills, and other precision tools to fit a new fixture into a void left by the removal of an old fixture. More than one person is required to perform modifications, and the use of general tools is also necessary.

These and other drawbacks exist.

SUMMARY OF THE INVENTION

Accordingly, an object of the present invention is to overcome these and other drawbacks in existing devices.

Another object of the present invention is to provide a convenient method for installing differently-designed canopy luminaire assemblies using existing luminaire structures.

Another object of the present invention is to allow the lens structure of canopy luminaire assemblies to be replaced in a convenient and inexpensive manner.

Another object of the present invention is to provide a device that may replace only part of an existing canopy luminaire yet have exposed portions with the look and feel of a luminaire with a different design from the existing canopy luminaire.

Another object of the present invention is to provide a system for using the housing and ballast from an existing canopy luminaire with the exposed, exterior components that match another canopy luminaire.

Another object of the present invention is to provide a system for installing a canopy luminaire structure in place of an existing luminaire with minimal use of tools.

According to these and other objects of the present invention, a method for installing a canopy luminaire in place of an existing lighting structure is provided. A method according to one embodiment of the present invention comprises the steps of removing the existing lens structure and electrical components, securing a deck structure to the housing, such that the deck structure is located substantially outside the housing, and securing an assembly structure to the deck structure.

These and other objects of the invention will be described in further detail in the accompanying drawings and specification.

DETAILED DESCRIPTION OF THE PREFERRED EMBODIMENTS

The present invention provides a method of installing a retrofit luminaire assembly in place of an existing canopy luminaire assembly.

Figure 5:
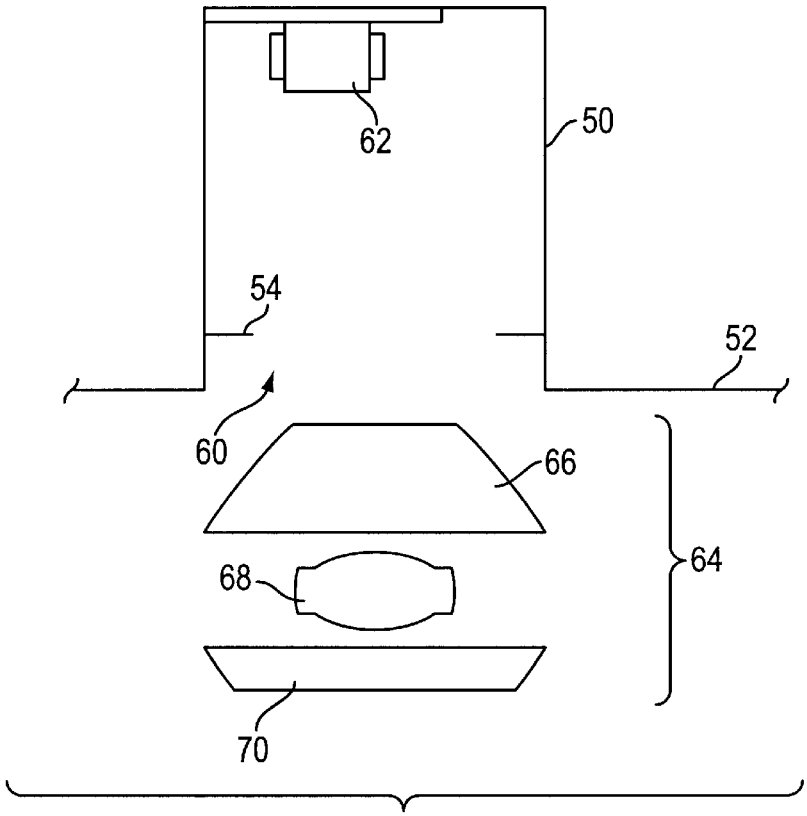
FIG. 5 depicts a schematic diagram of a canopy luminaire assembly to be retrofitted according to an embodiment of the present invention.

An existing box canopy luminaire, as illustrated in FIG. 5, may comprise a housing 50 located atop a deck canopy 52. Existing box canopy luminaires may comprise the CIVIC-DPL sold by Spaulding Lighting Corporation, for example. Housing 50 may have housing flanges 54 connected thereto. Housing flanges 54 may also be installed according to the present invention or may not be connected to the housing but only to the canopy itself. Electrical components 62 may be located within housing 50, and may further comprise a ballast, a capacitor, and a starter. Electrical components 62 may also comprise other or fewer devices. Lens structure 64, which may comprise a reflector 66, a lamp 68, and a lens assembly 70, may be located within deck canopy aperture 60.

The process of retrofitting an existing canopy luminaire may comprise first removing lens structure 64. According to one embodiment of the present invention, retrofitting may also comprise removing electrical components 62. According to another embodiment, electrical components 62 may be left in housing 50.

According to an embodiment of the present invention, a retrofit luminaire assembly 1 may be connected to housing 50 and deck canopy 52 upon removing components of an existing recess box canopy luminaire. Specifically, a retrofit luminaire assembly kit may be provided that comprises a retrofit luminaire assembly 1 and a mechanism that secures retrofit luminaire assembly 1 to housing 50 to fit snugly against the underside of a deck canopy 52. Retrofit luminaire assembly 1 may comprise a lighting structure 2, an assembly structure 4, and a deck structure 6. Assembly structure 4 and deck structure 6 may be collectively referred to as adapter structure 7. Lighting structure 2 may be attached to assembly structure 4 and may be electrically connected to electrical components 62.

The securement mechanism may comprise a housing bracket 8 that may be secured to housing flanges 54 of housing 50. In this embodiment, housing brackets 8 may be attached to housing flanges 54 located on housing 50. Deck structure 6 may be attached to housing brackets 8 by latch 38. The securement mechanism may comprise a spring clip 37 to secure retrofit luminaire assembly 1 to housing flanges 54. According to this embodiment, spring clip 37 may be used to secure deck structure 6 to housing flange 54. Assembly structure 4 and deck structure 6 may be pivotally attached by a hinge 28.

The various structures and methods for retrofitting an existing canopy luminaire will be described in greater detail. Other structures and methods may also be used. Embodiments of the present invention are described with reference to FIGS. 1–12.

Figure 1:
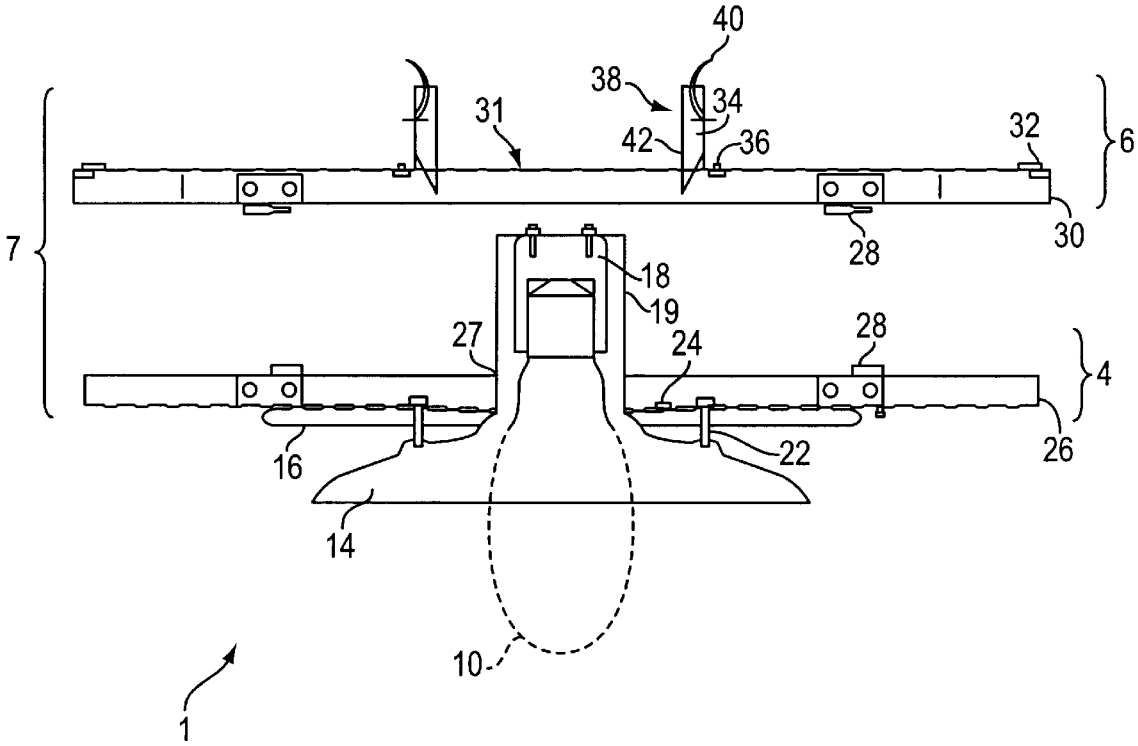
FIG. 1 depicts a cut-away front view of a retrofit luminaire assembly according to an embodiment of the present invention.
Figure 2:
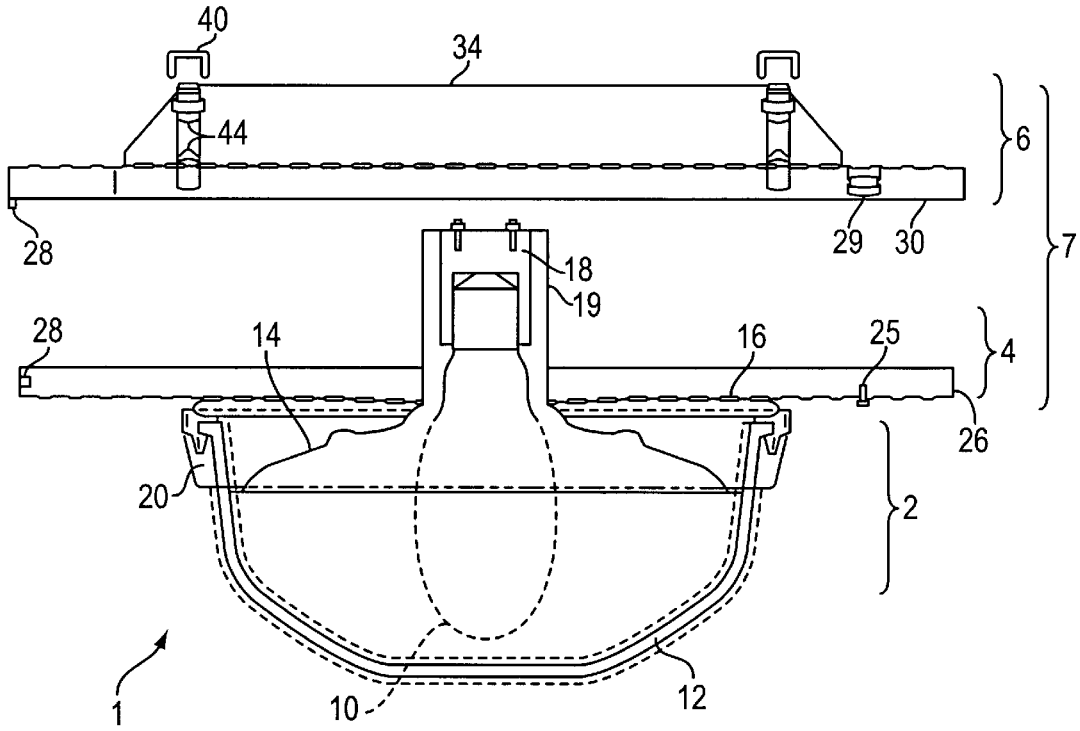
FIG. 2 depicts a cut-away side view of a retrofit canopy luminaire assembly according to an embodiment of the present invention.

FIGS. 1 and 2 depict a cut-away front and a cut-away side view of a retrofit luminaire assembly 1 according to an embodiment of the present invention. Lighting structure 2 may comprise a light source 10 which may be connected to a socket 18 within a socket housing 19. Socket 18 in socket housing 19 may be connected to reflector 14. Socket housing 19 may be attached to assembly fixture 26. Lens 12 surrounds and protects light source 10. A lighting structure 2 may include a reflector 14, used to direct the light, which may be joined to base pan 16 by reflector fasteners 22. A bezel 20 may be placed over and snap onto lens 12.

According to an embodiment of the invention, base pan 16 may be made of a material of sufficient strength to support lens 12 and reflector 14, such as, for example, metal, plastic, or other such material. Base pan 16 may also be molded or die-cast. In an embodiment of the invention, lens 12 may be made from a translucent material, such as, for example, glass, plastic or similar material. Socket housing 19 may be comprised of metal, such as stainless steel, aluminum, or other such material.

Assembly structure 4 may comprise an assembly fixture 26 having an assembly aperture 27. Assembly fixture 26 may comprise a plate-like structure. Other shapes, sizes, and arrangements of assembly fixture 26 may also be used. Assembly fixture 26 may be made of a light-weight material, such as, for example, plastic, metal, or the like. Other materials may also be used.

Deck structure 6 may comprise a deck fixture 30 having a deck fixture aperture 31, latch brackets 34 attached to deck fixture 30, and latches 38 attached to latch brackets 34. In one embodiment of the present invention, deck fixture 26 may be a plate-like structure. Other shapes, sizes and arrangements of deck fixture 30 may also be used.

In one embodiment of the present invention, latch brackets 34 may be attached to the upper portion of deck fixture 30. Latch brackets 34 may be a variety of shapes. In one embodiment, latch brackets 34 may be formed in the shape of an "L", as best illustrated in FIG. 1, and attached to deck fixture 30 by latch bracket fastener 36. Latch brackets 34 may also be attached by welding, adhesives, or other attachment methods. Latch brackets 34 may be made of metal, plastic, or other light weight material.

According to an embodiment of the invention, latch bracket 34 may comprise an integral part of deck fixture 30, where a portion is turned up (bent), thereby allowing latch 38 to be attached. Other structures may also be used.

Latch 38 may be attached to latch bracket 34 to allow attachment of deck fixture 30 to housing 50. Latch 38 may be a toggle latch comprising a link 40 and a clamp 42. Latch 38 may be attached to latch bracket 34 by latch fasteners 44, as depicted in FIG. 2. Latch 38 may also be attached in other manners, such as by welding, adhesives, or other known methods of attachment.

A gasket 32 may be attached to the upper portion of deck fixture 30, so as to be interposed between canopy 52 and deck fixture 30. In one embodiment, gasket 32 may be rectangular and may surround canopy aperture 60. Gasket 32 may be made of rubber, foam, plastic, felt, or other suitable seating material to prevent liquid from seeping into the lighting components in lighting structure 2. The function of gasket 32 will be further described below. Deck fixture 30 may be made of a light-weight material, such as, for example, plastic, metal, or the like. Other materials may also be used.

Lighting structure 2 may be attached to assembly structure 4 by assembly fasteners 24. Reflector 14 and socket housing 19 of lighting structure 2 may be inserted through assembly plate aperture 27. Assembly fasteners 24 may be provided to attach base pan 16 to assembly fixture 26, thereby connecting lighting structure 2 to assembly structure 4. In one embodiment of the invention, reflector fasteners 22 may be used to attach reflector 14 to base pan 16, and to attach base pan 16 to assembly fixture 26, thereby further connecting lighting structure 2 to assembly structure 4. Base pan fasteners 24 and reflector fasteners 22 may both be used to attach lighting structure 2 to assembly structure 4. A gasket (not shown) may also be placed between base pan 16 and assembly fixture 26 to seal the area around assembly aperture 27. Other attachment methods may also be used.

Figure 3:
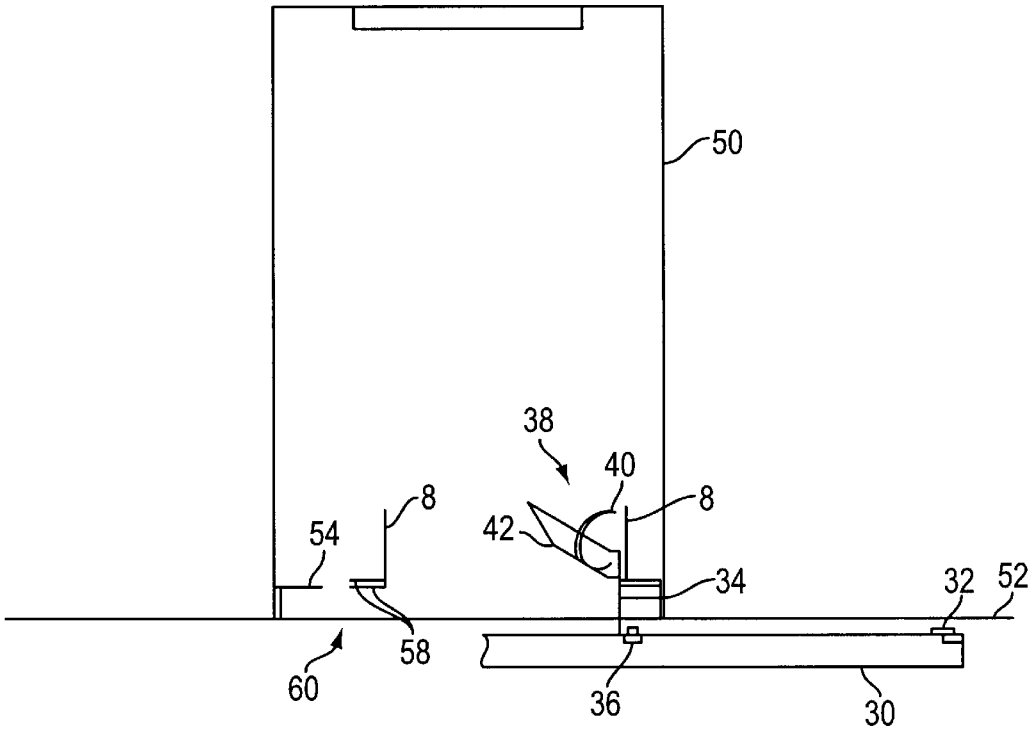
FIG. 3 depicts a cut-away front view of an existing luminaire assembly housing and housing brackets and a partial view of an adapter plate according to an embodiment of the present invention.
Figure 4:
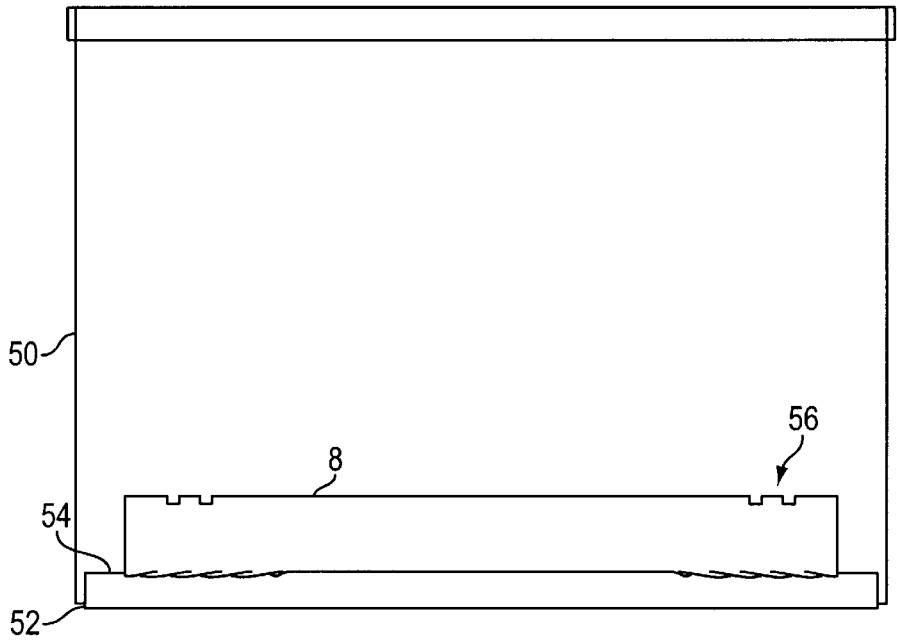
FIG. 4 depicts a cut-away side view of an existing luminaire assembly housing and housing brackets according to an embodiment of the present invention.
Figure 6:
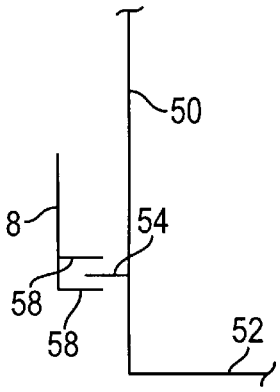
FIG. 6 depicts a schematic diagram of a housing bracket installed on a housing flange according to an embodiment of the present invention.
Figure 7:
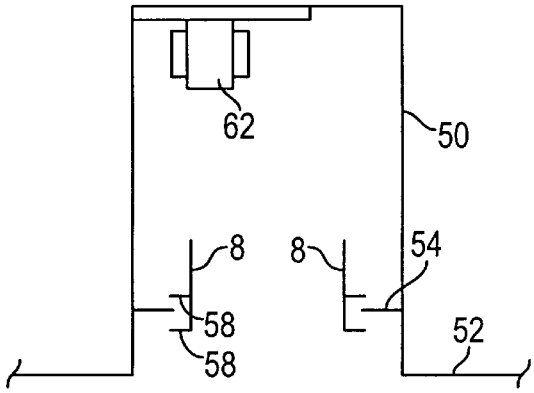
FIG. 7 depicts a schematic diagram of a housing with housing brackets installed according to an embodiment of the present invention.

FIGS. 3 and 4 illustrate an expanded view of a retrofitted canopy luminaire assembly according to one embodiment of the present invention, and more specifically a view of a deck structure 6 being connected to the housing 50 of a retrofit canopy luminaire assembly. Housing 50 may be located above deck canopy 52. Housing brackets 8 may be attached to housing flanges 54. In one embodiment of the invention, housing bracket 8 may have two bracket flanges 58 which are substantially parallel to each other, as illustrated in FIGS. 6 and 7. Bracket flanges 58 may be inserted onto housing flange 54 to support housing brackets 8. Other methods of attaching housing bracket 8 to housing flange 54 or housing 50 may also be used. Additionally, other methods of attaching housing flanges 54 to housing 50 may also be used. According to an embodiment of the invention, if housing flanges 54 are not present in housing 50, housing brackets 8 may be affixed to housing 50 in another manner.

Figure 10:
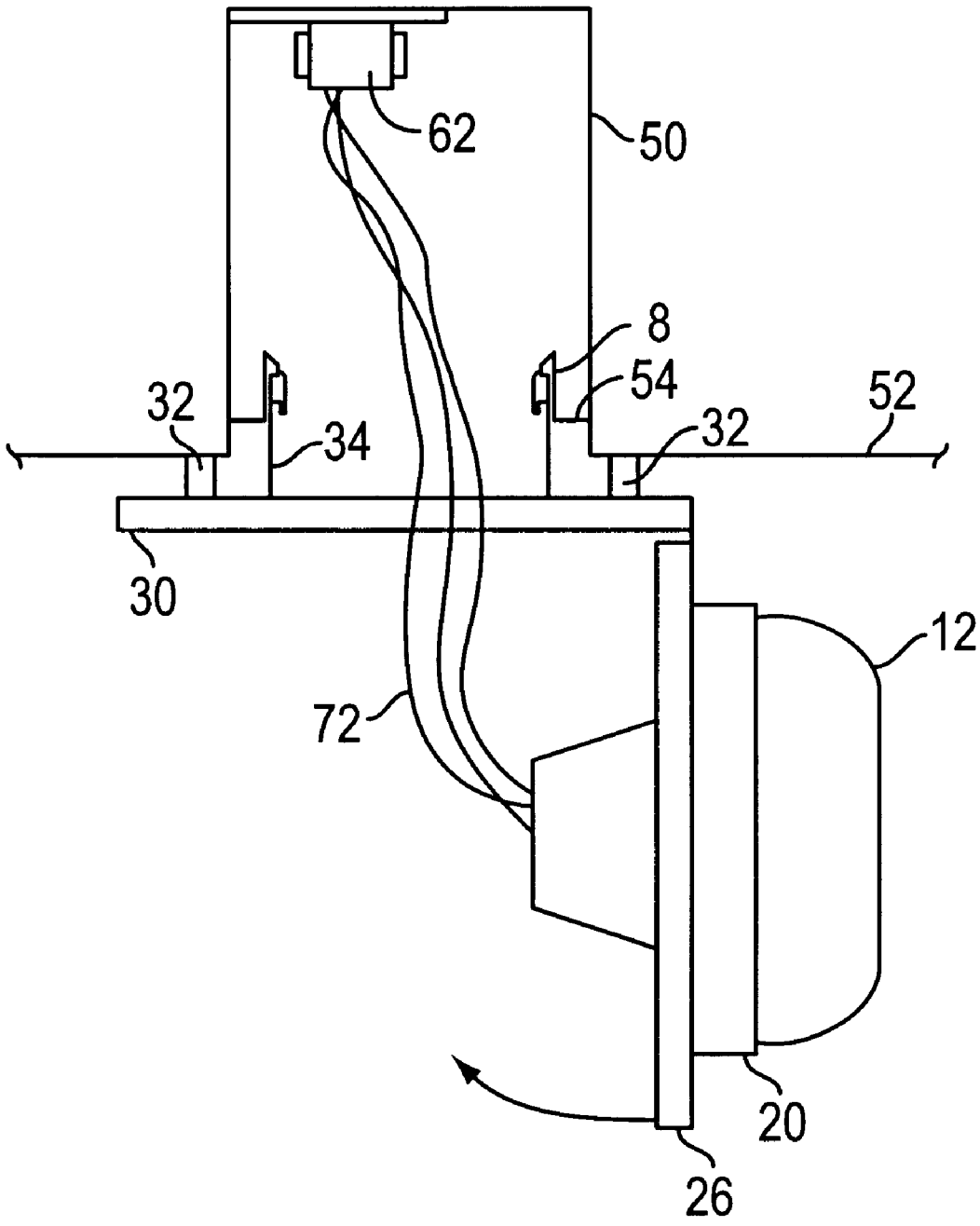
FIG. 10 depicts a schematic diagram of a retrofit canopy luminaire assembly with an assembly structure pivoted from a deck structure to allow electrical connection of lighting structure according to an embodiment of the present invention.

According to an embodiment of the present invention, deck structure 6 and assembly structure 4 may be attached together. One attachment device may be a hinge 28. Hinge 28 enables assembly structure 4 to be pivoted relative to deck structure 6 as illustrated in FIG. 10. Housing 50 may be accessible through deck fixture aperture 31 due to the relative movement of assembly structure 4 to deck structure 6. Access to housing 50 may allow lighting structure 2 to be electrically connected by wiring 72 to electrical components 62 in housing 50, as illustrated in FIG. 10.

Accordingly, an improved method of installing a retrofit canopy luminaire assembly is provided, because a single person may install and electrically connect the entire retrofit assembly. Also, because one person may easily access the inside of the canopy luminaire assembly, further service, including repairs and replacements, is also easier. Captive screws 25, located opposite of hinge 28, may be secured to cage nuts 29 to secure assembly structure 4 to deck fixture 6 in an upright position. Other fasteners, which may include screws, bolts, or other types of fasteners, may be used. Other methods of securing deck structure 6 to assembly structure 4 may also be used.

In another embodiment of the invention, deck structure 6 and assembly structure 4 may be attached by non-pivotable mechanism. Non-pivotable mechanisms may include fasteners, welding, adhesives, or other attachment methods.

Deck structure 6 and assembly structure 4 may also comprise a single structure, referred to as an adapter structure. Latch brackets 34 may be attached to the upper portion of an adapter structure, while light structure 2 may be attached to the lower portion of the adapter structure. Adapter structure functions similar to the functions of assembly structure 4 and deck structure 6. Other types of deck and assembly structures may also be used.

Figure 8:
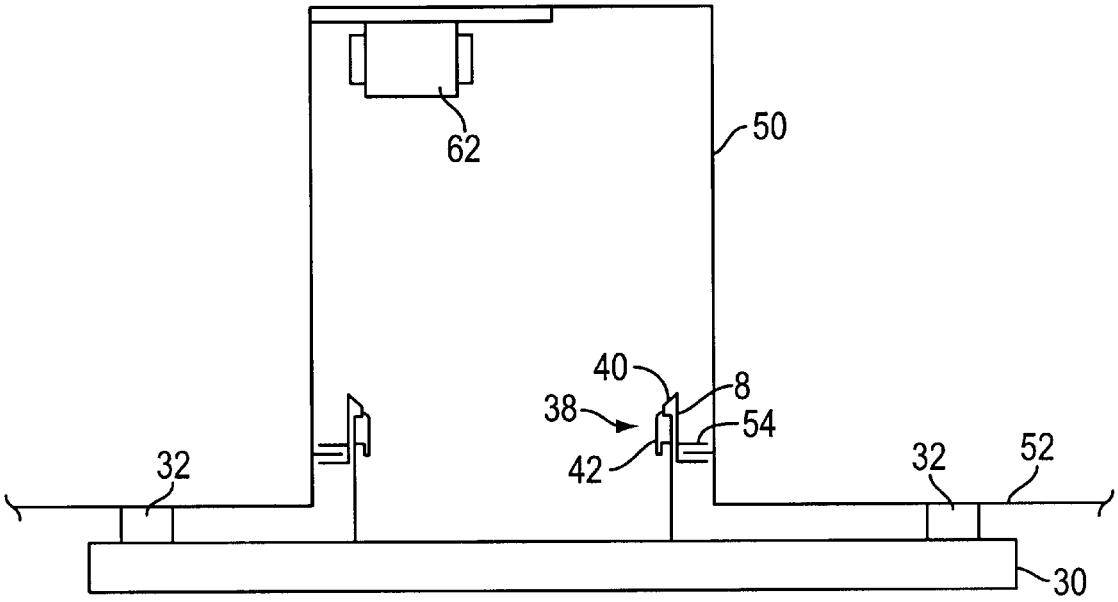
FIG. 8 depicts a schematic diagram of a housing with a deck structure attached to the housing brackets according to an embodiment of the present invention.
Figure 9:
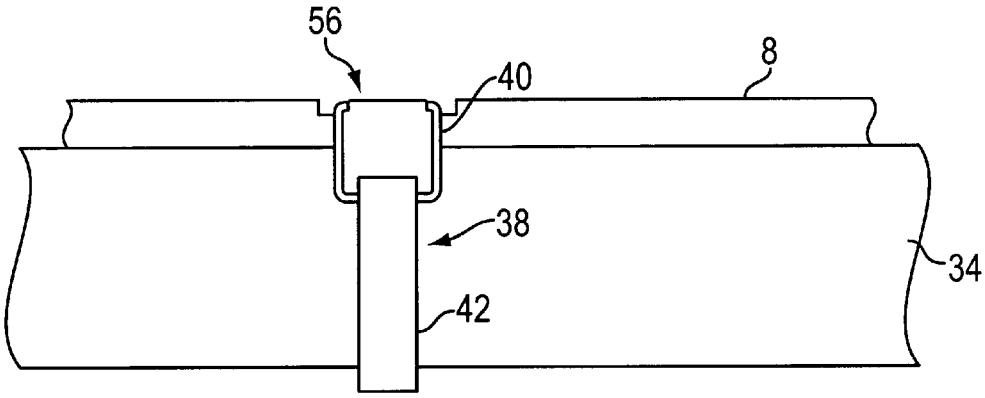
FIG. 9 depicts a schematic diagram of a link of a latch attached to latch teeth of a housing bracket according to an embodiment of the present invention.

As further illustrated in FIGS. 3 and 4, deck structure 6 may be positioned below deck canopy 52. In one embodiment of the invention, housing 50 and deck canopy aperture 60 may be aligned. Latch brackets 34 may also be aligned with deck canopy aperture 60. Deck structure 6 may be raised, thereby inserting latch brackets 34 through deck canopy aperture 60 and into housing 50, as illustrated in FIGS. 3 and 8. In one embodiment of the invention, housing bracket 8 may have latch teeth 56. As best illustrated in FIG. 9, link 40 of latch 38 may be placed in latch teeth 56. Clamp 42 may then be pushed into a locking position, such as downward in this embodiment, such that link 40 locks onto latch teeth 56 and supports retrofit canopy luminaire assembly 1. Other methods of attaching a retrofit luminaire assembly 1 to a housing may be used.

According to one embodiment of the present invention, pushing clamp 42 of latch 38 into locking position raises deck fixture 30 so as to be substantially flush with deck canopy 52. Gasket 32, interposed between deck fixture 30 and deck canopy 52, seals the inner portion of the retrofit luminaire assembly 1.

Use of latch 38 to lock onto latch teeth 56 allows a tool-less manner for attaching the retrofit canopy luminaire assembly 1 to housing 50. Installation of a retrofit canopy luminaire assembly may be performed more easily, as tools are not necessary, thereby enabling one person to install and electrically connected the retrofitted assembly.

Figure 11:
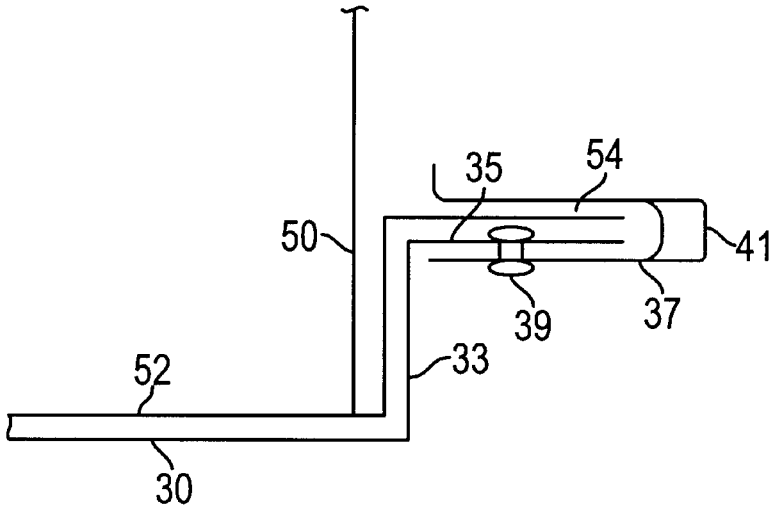
FIG. 11 depicts a schematic diagram of a side view of a deck structure secured to housing flanges by a spring clip according to one embodiment of the invention.
Figure 12:
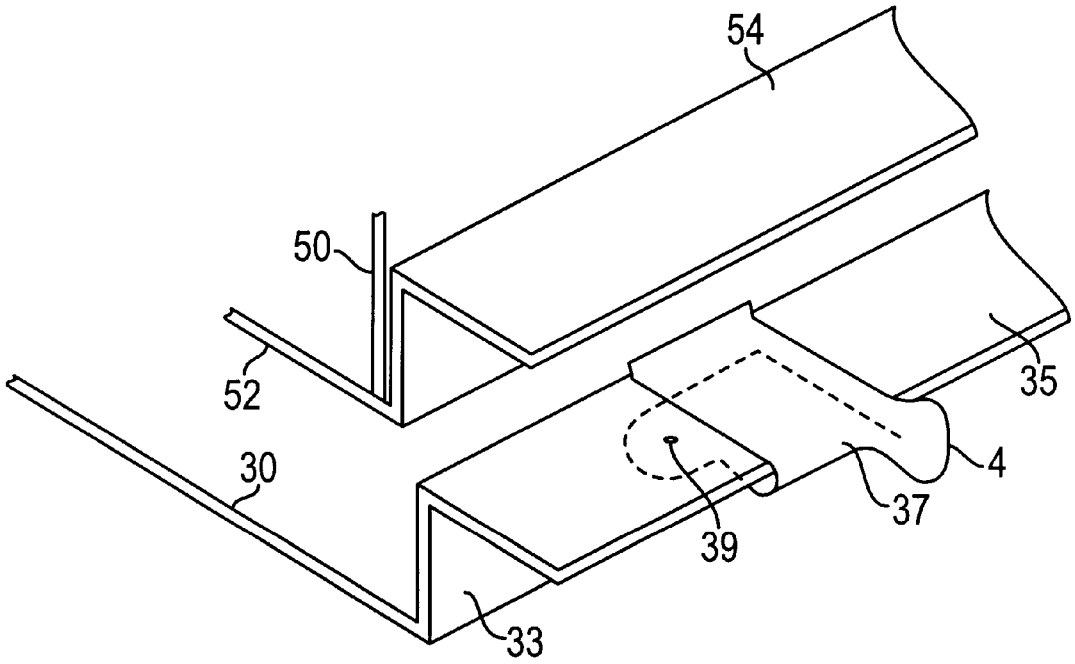
FIG. 12 depicts a schematic diagram of an isometric view of a deck structure and spring clip arrangement for connecting the deck structure to housing flanges according to an embodiment of the invention.

FIGS. 11 and 12 illustrate another embodiment of the present invention for securing retrofit luminaire assembly 1 to housing 50. A portion of deck fixture 30 may include a perpendicular portion 33 and a parallel portion 35. According to an embodiment of the present invention, spring clip 37 may be attached to parallel portion 35 with a pivot 39. Deck fixture 30 may be configured such that perpendicular portion 33 and parallel portion 35 may be inserted through deck canopy aperture 60. Parallel portion 35 may be positioned to be substantially flush with housing flange 54. Spring clip 37 rotates on pivot 39 to secure parallel portion 35 and housing flange 54. Spring clip 37 may have a spring clip tab 41 with which to rotate spring clip 37 about pivot 39, thereby allowing attachment of housing flange 54 and parallel portion 35 without the use of tools. Deck fixture 30 may thereby be secured to housing flange 54, and thereby securing retrofit luminaire assembly 1 to housing 50. Other methods for securing retrofit luminaire assembly 1 to housing 50 may also be used.

Figure 13:
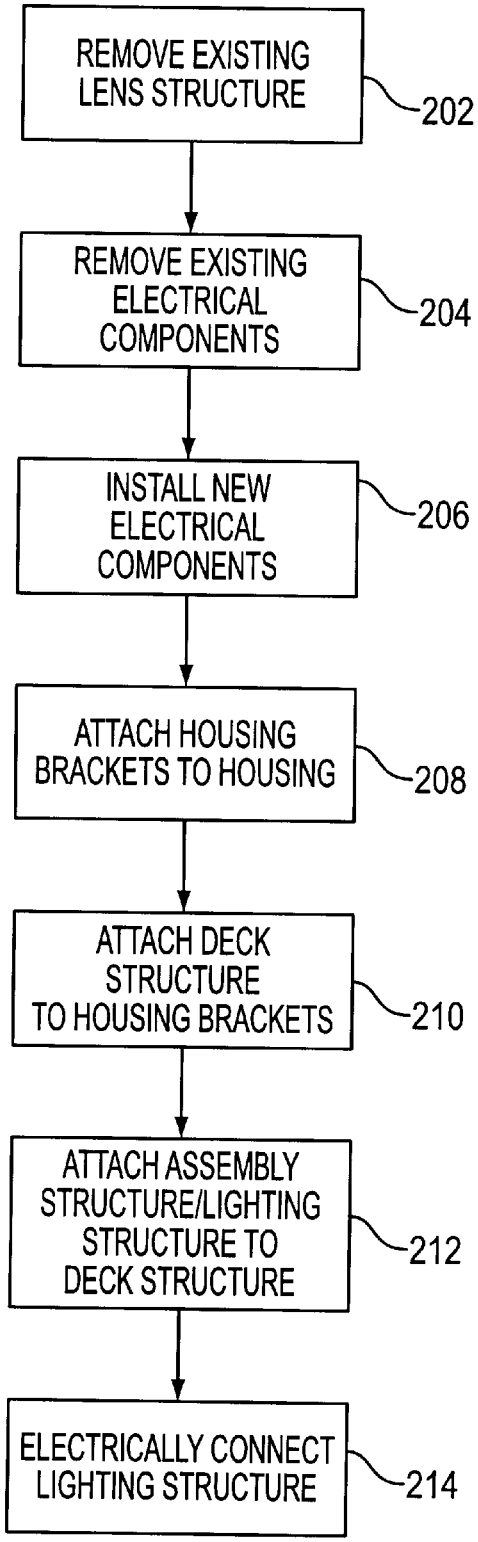
FIG. 13 depicts a method of assembling a retrofit canopy luminaire assembly according to an embodiment of the present invention.

A brief description of steps which may be employed to retrofit a canopy luminaire assembly according to one embodiment of the present invention is given to the context of FIG. 13, with references to portions illustrated in FIGS. 1–12. In a first step, existing lens structure 64 may be removed at step 202. The existing electrical components 62 may then be removed at step 204. Electrical devices 62 may comprise a ballast, a starter, a capacitor, and/or other electrical components. The step of installing new electrical components 62 may occur at step 206, including a new ballast, for example. In another embodiment of the present invention, existing electrical components 62 may be left in the canopy luminaire assembly.

Housing brackets 8 may be attached to housing flanges 54 located in a housing 50 at step 208. In another embodiment of the invention, housing brackets 8 may be directly attached to housing 50. The manner for attachment may comprise fasteners (i.e. rivets, bolts, screws, etc.), adhesives, welding, or other mechanisms.

Deck structure 6 may be attached to housing brackets 8 at step 210. One embodiment of the present invention contemplates use of latch 38 to attach deck structure 6 to housing bracket 8. Deck structure 6 may have a latch bracket 34 upon which latch 38 may be mounted. Other mechanisms for attaching deck structure 6 may also be used.

In the embodiment of FIGS. 11 and 12, steps 208 and 210 may be replaced with a single step of securing the deck assembly to the housing 50 using spring clips 37. Assembly structure 6 may be attached to deck structure 8 at step 212. As previously discussed, assembly structure 6 and deck structure 4 may be pivotally attached by hinge 28. Non-pivotable attachment, such as fasteners, may also be used. Lighting structure 2 may be electrically connected at step 214 with the assembly structure 8 pivoted open. According to an embodiment of the present invention, lighting structure 2 may be preassembled to assembly structure 4, before assembly structure 4 is secured to deck structure 6.

The method of installing a retrofit canopy luminaire assembly may also occur in a different order. For example, it may be desirable to attach deck structure 6 to assembly structure 4 before attaching deck structure 6 to housing brackets 8. Other orders of steps of installing a retrofit canopy luminaire may also be used.

Figure 14:
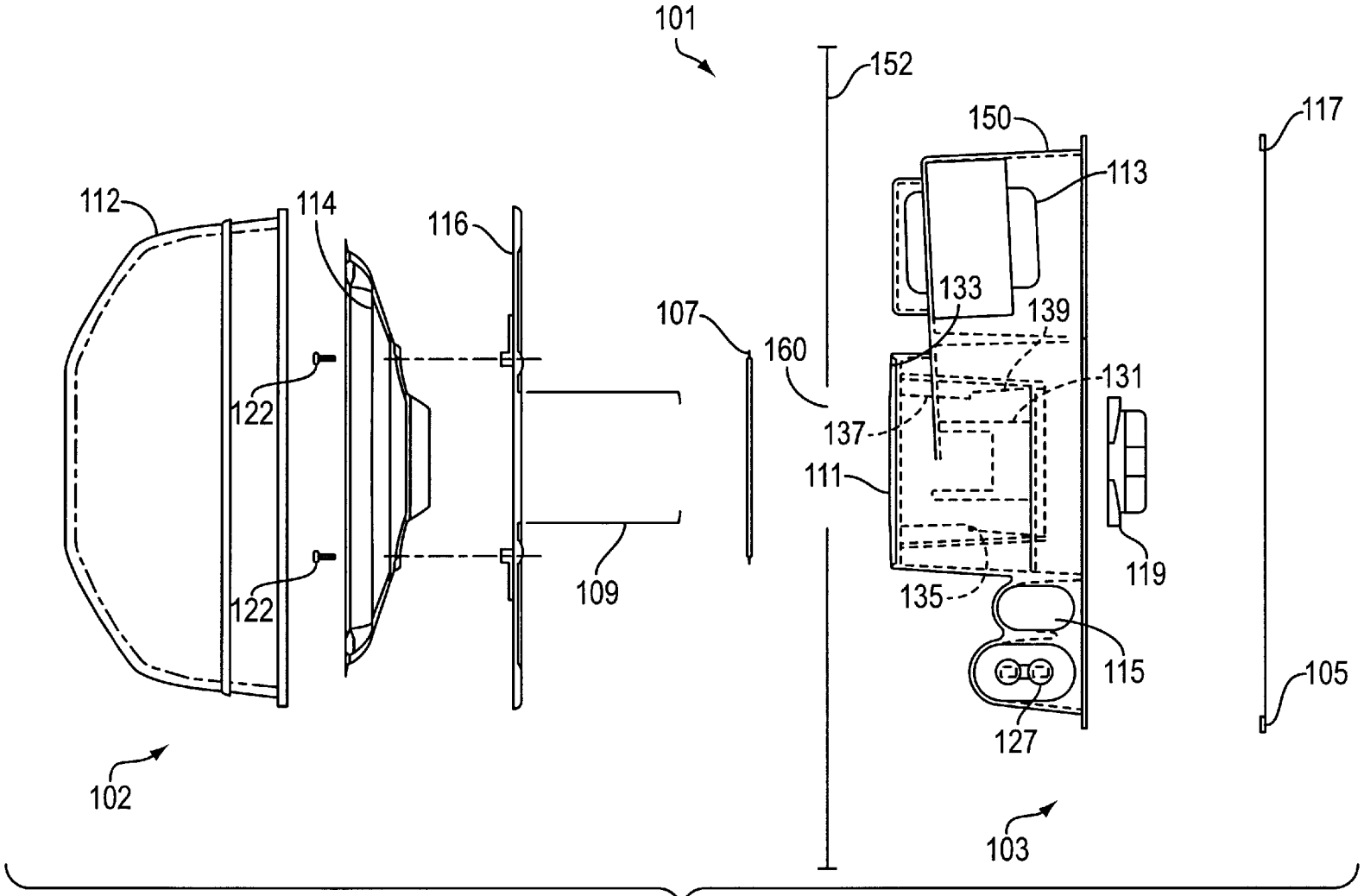
FIG. 14 depicts an expanded view of a canopy luminaire assembly the exposed portion of which may resemble the retrofit canopy luminaire assembly of an embodiment of the present invention.
Figure 15:
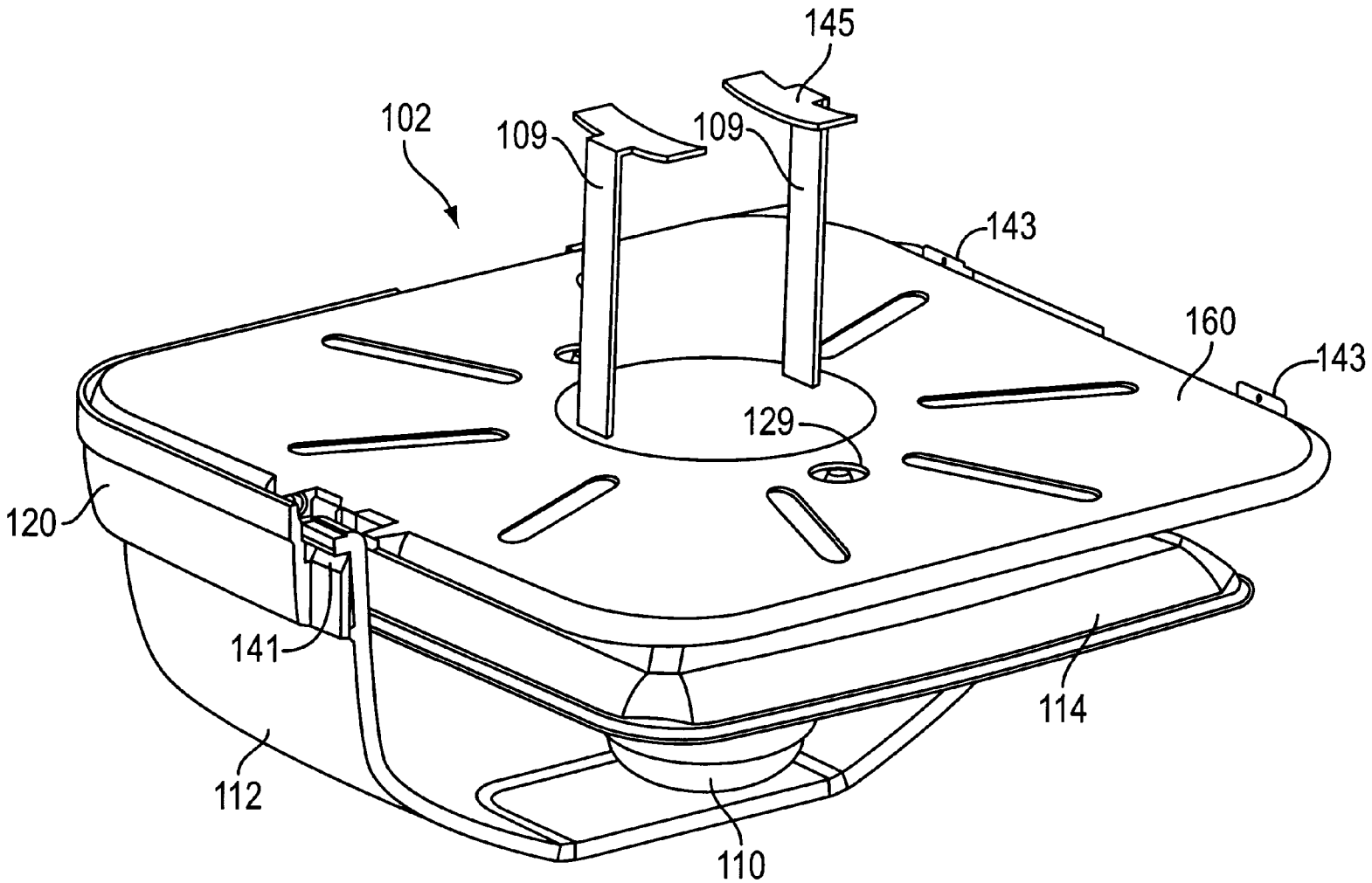
FIG. 15 depicts a partial cut-away view of the canopy luminaire assembly of FIG. 14.

FIG. 14 illustrates an expanded side view of a canopy luminaire 101 the exposed portion of which the present invention may resemble, while FIG. 15 illustrates a partial cut away view of the same canopy luminaire assembly. A detailed description of this luminaire may be provided in U.S. patent application Ser. No. 09/089,214 and U.S. Design Pat. No. 405,207, which are incorporated by reference. Like terms in the retrofit canopy luminaire assembly will generally correspond to like terms in the canopy luminaire assembly of FIGS. 14 and 15. The canopy luminaire assembly 101 comprises a lower portion 102 and a ballast section 103. The lower portion 102 may include a lens 112 and a reflector 114. Reflector 114 may be attached to a base pan 116 by fasteners 122. Lens 112 may be attached to base pan 116. A light source 110 is located within lens 112. Base pan 116 may be provided with one or more draw clamp brackets 109 which may extend up from reflector 114. As shown, draw clamp brackets 109 may be attached to base pan 106 by fasteners 129 (FIG. 15). In one embodiment according to the present invention, draw clamp bracket 109 may be substantially perpendicular to the plane of the base pan 116. Other arrangements may also be used. A gasket 107 may be placed around the draw clamp brackets 109 and onto the base pan 106. Gasket 107 helps to seal the canopy luminaire assembly and may be made of rubber, felt, plastic, foam, or other sealing material.

Ballast section 103 may include a housing 150 and a top cover 117. Housing 150 may contain a ballast 113, a starter 115, and a capacitor 127. Top cover 117 may fit on the housing 150 with a cover gasket 105 disposed between top cover 117 and housing 150. Housing 150 may rest on a deck canopy 152, with a housing aperture 111 aligned with a canopy aperture 160, and gasket 133 interposed between housing 150 and deck canopy 152 for sealing.

An overview of the assembly is now provided. Base pan 116, reflector 114, draw clamp brackets 109, and lens 112 may be assembled and attached together to form lower portion 102. Additionally, housing 150 may be assembled to include ballast 113, capacitors 127, and starter 115. Housing 150 may also have an aperture portion 111 disposed in a lower portion of housing 150. Aperture 111 may have a circumference approximately equal to the size of canopy aperture 160. To assemble lower portion 102 to housing 150, any manner of providing a component that attaches to another component may be provided. According to one embodiment, however, draw clamp brackets 109 may cooperate with aperture 111 to secure lower portion 102 to housing 150 through canopy aperture 160. Housing aperture 111 may be located in the lower portion of housing 160. Draw clamp brackets 109 are inserted into housing aperture 111 located within housing 150 to secure lower portion 102 to housing 150. According to another embodiment, a locking cam 119 may be used to secure lower portion 102 to housing 150.

Draw clamp brackets 109 may be inserted through canopy aperture 160 and housing aperture 11, and into housing 150. Housing 150, as shown in FIG. 14, also has first bracket walls 137, which extend into housing 150 from housing aperture 111. According to one embodiment of the present invention, first bracket walls 137 may be tapered inward toward the center of canopy aperture 160. In addition, first bracket walls 137 may be provided with bracket notches 135 formed between the inner edge of first bracket wall 137 and second bracket wall 139. According to one embodiment, first bracket walls 137 may have an insert portion to receive extension portions of draw clamp brackets 109 between bracket notches 25.

Draw clamp brackets 109 may be inserted into ballast housing 150. According to one embodiment, draw clamp brackets 109 may be spaced so that winged bracket portions 145 of draw clamp brackets 109 press against first bracket wall 137, causing winged bracket portions 145 to deflect toward each other, because first bracket wall 137's inner diameter may be less than the diameter between winged bracket portions 145. Along first bracket walls 137 are bracket notches 135. When draw clamp brackets 109 are inserted to where winged bracket portions 145 are above bracket notches 135, draw clamp brackets 109 set into the insert portion of first bracket walls 137, and winged bracket portions 145 rest in bracket notches 135, thereby holding lower portion 102 within housing 150. Other methods of securing draw clamp brackets 109 within housing 150 may also be used. Other methods, may include fasteners, glue, welding or the like.

In one embodiment, hinges 143, and a latch 141 are located on the base pan 116. Hinges 143 and latch 141 allow lens 110 to be opened to allow changing of light source 110. As seen in FIG. 15, the canopy luminaire of the present invention may also be provided with a bezel 120. Bezel 120 may attach to edge portions provided on lens 112. Additionally, one or more snap bosses (not shown) may be provided that cooperate with bezel 120 to secure bezel 120 to lens 112. Bezel 120 may comprise a substantially narrow piece that covers the top of lens 112 and the edge of base pan 116. The top of bezel 120 thus presses against the bottom of canopy 152 during operation.

The retrofit luminaire assembly 1 of the present invention resembles the exposed portion of the canopy luminaire assembly described in reference to FIGS. 14 and 15. Accordingly, from below, a person may not be able to tell a difference between a new canopy luminaire and a retrofit canopy luminaire assembly. The present invention allows canopy luminaire assemblies to be conveniently and inexpensively replaced. More specifically, the present invention allows part of a canopy luminaire assembly to be replaced so as to resemble other, neighboring assemblies.

Additionally, like parts between retrofit canopy laminaire assembly and the canopy luminaire assembly which the present invention may resemble may be used so that, for example, bezel 20 and bezel 120 may be the same. That adds to increased replaceability and fewer parts to be replaced.

Other embodiments and uses of the invention will be apparent to those skilled in the art from consideration of the specification and practice of the invention disclosed herein. The specification and examples should be considered exemplary only. The scope of the invention is only limited by the claims appended hereto.

What is claimed is:

1. A method for installing a canopy luminaire to replace an existing luminaire having a housing comprising the steps of:

removing interior components of the existing luminaire;

securing a non-electrical adapter structure to the housing through an aperture in the canopy, the non-electrical adapter structure being located substantially below the canopy, and having a lighting assembly secured thereto; and connecting the lighting assembly to electrical components in the housing through at least a portion of the non-electrical adapter structure.

2. The method according to claim 1, wherein the non-electrical adapter structure comprises a deck structure and an assembly structure, and wherein the step of securing the non-electrical adapter structure further comprises the steps of:

securing the deck structure to the housing; and mounting the assembly structure to the deck structure.

3. The method according to claim 1, wherein the step of securing includes the steps of:

mounting at least one housing bracket to the housing of the existing luminaire; and securing the non-electrical adapter structure to the housing bracket.

4. The method according to claim 3, wherein the step of mounting further comprises mounting the housing bracket to at least one housing flange of the housing of the existing luminaire.

5. The method according to claim 2, wherein the deck structure includes a deck fixture having at least one substantially parallel portion, and wherein the step of securing the deck structure further comprises securing the substantially parallel portion to at least one housing flange of the housing of the existing luminaire.

6. The method of claim 5, wherein the step of securing the non-electrical adapter structure includes securing the substantially parallel portion to the housing flanges with a spring clip.

7. The method according to claim 2, wherein the step of mounting the assembly structure further comprises the step of pivotally mounting the assembly structure to the deck structure.

8. The method according to claim 1, wherein the step of removing interior components of the existing luminaire comprises the step of removing an existing ballast and further comprises the step of installing a new ballast in the housing.

9. The method according to claim 1, wherein the non-electrical adapter structure comprises a deck fixture and at least one latch bracket, and wherein the step of securing the non-electrical adapter structure further comprises the step of securing the latch bracket to the housing.

10. The method according to claim 9, wherein the non-electrical adapter structure further comprises a latch located on the latch bracket, and wherein the step of securing the latch bracket to the housing bracket comprises the step of using the latch to secure the latch bracket to the housing bracket.

11. A retrofit canopy luminaire kit for replacing an existing luminaire having a housing, the kit comprising:

a lighting structure comprising an adapter structure and a lighting assembly;

means for connecting the lighting structure to the housing so that the adapter structure and lighting assembly is substantially below the canopy; and means for permitting access to the housing through at least a portion of the adapter structure to enable the lighting structure to be connected to electrical components in the housing.

12. The apparatus of claim 11, wherein the means for connecting comprises an adapter structure for connecting the lighting structure to the housing.

13. The apparatus of claim 12, wherein the adapter structure further comprises a deck structure having at least one substantially parallel portion, and the means for connecting includes means for connecting the substantially parallel portion to at least housing flange of the housiing of the existing luminaire.

14. The apparatus of claim 11, wherein the means for connecting comprises at least one housing bracket secured to the housing of the existing luminaire.

15. The apparatus of claim 14, wherein the housing bracket is secured to at least one housing flange of the housing of the existing luminaire.

16. The apparatus of claim 11, wherein the adapter structure comprises a deck structure and an assembly structure, wherein the assembly structure is mounted to the deck structure.

17. The apparatus of claim 16, wherein the deck structure comprises a deck fixture and at least one latch structure, wherein the latch structure secures to the housing.

18. The apparatus of claim 16, further comprising a pivotal means for securing the deck structure to the assembly structure.

19. The apparatus of claim 11, wherein the means for connecting comprises a spring clip.

* * * * *